United States Patent [19]

Burkel et al.

[11] Patent Number: 4,878,470

[45] Date of Patent: Nov. 7, 1989

[54] DEVICE FOR ACTUATING BUTTERFLY THROTTLE VALVE OF AN INTERNAL COMBUSTION ENGINE

[75] Inventors: Rainer Burkel, Asberg; Kurt Engelsdorf, Besigheim; Rolf Gawlik, Beilstein; Karl-Heinz Hägele, Vaihingen/Enz, all of Fed. Rep. of Germany

[73] Assignee: Robert Bosch GmbH, Stuttgart, Fed. Rep. of Germany

[21] Appl. No.: 257,967

[22] Filed: Oct. 13, 1988

[30] Foreign Application Priority Data

Oct. 30, 1987 [DE] Fed. Rep. of Germany ..... 3736831

[51] Int. Cl.[4] ..... F02D 9/02; F15B 1/02

[52] U.S. Cl. ..... 123/401; 123/360

[58] Field of Search ..... 123/401, 360, 378

[56] References Cited

U.S. PATENT DOCUMENTS

| | | | |
|---|---|---|---|
| 2,897,906 | 8/1959 | Brueder | 123/360 X |
| 3,724,430 | 4/1973 | Adler | 123/360 X |
| 3,822,679 | 7/1974 | Hobo et al. | 123/360 X |
| 4,235,155 | 11/1980 | Shafer | 91/426 X |
| 4,510,905 | 4/1985 | Leiber | 123/401 X |

*Primary Examiner*—Tony M. Argenbright

*Attorney, Agent, or Firm*—Michael J. Striker

[57] ABSTRACT

A device for actuating a butterfly throttle valve of an internal combustion engine includes a hydraulic setting member for rotating a shaft of the throttle valve. The hydraulic setting member is driven by a branch flow of fuel delivered by a fuel pump and acting as pressure medium. The branch flow passes through a series of connection of adjustable throttles connected in a hydraulic bridge circuit. The throttles are adjusted by a regulating signal corresponding to the difference between an actual position signal delivered by a position sensor coupled to the throttle valve, and a desired position sensor coupled for example to a gas pedal of the motor vehicle.

7 Claims, 2 Drawing Sheets

DEVICE FOR ACTUATING BUTTERFLY THROTTLE VALVE OF AN INTERNAL COMBUSTION ENGINE

BACKGROUND OF THE INVENTION

The present invention relates to a device for actuating a butterfly throttle valve of an internal combustion engine having a fuel pump and a hydraulic setting member supplied by a pressure medium to set the position of the throttle valve. Known actuating devices of this kind are relatively expensive to manufacture inasmuch as adapting of fitting component parts must be provided in the hydraulic setting member. In addition, due to impurities in the supplied fuel interferences may result.

SUMMARY OF THE INVENTION

It is, therefore, a general object of the present invention to overcome the aforementioned disadvantages.

More particularly, it is an object of the invention to provide an improved actuating device which is relatively simple in construction.

Another object of this invention is to provide such an improved actuating device which while using conventional and inexpensive electronic components is reliable in operation.

In keeping with these objects and others which will become apparent hereafter, one feature of this invention resides in supplying the hydraulic setting member which is coupled to the butterfly throttle valve with fuel delivered by the fuel pump, controlling the fuel flow by adjustable control means, and adjusting the control means in response to a regulating signal generated by an electronic control circuit which compares an actual position signal of the hydraulic setting member with a desired setting signal.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
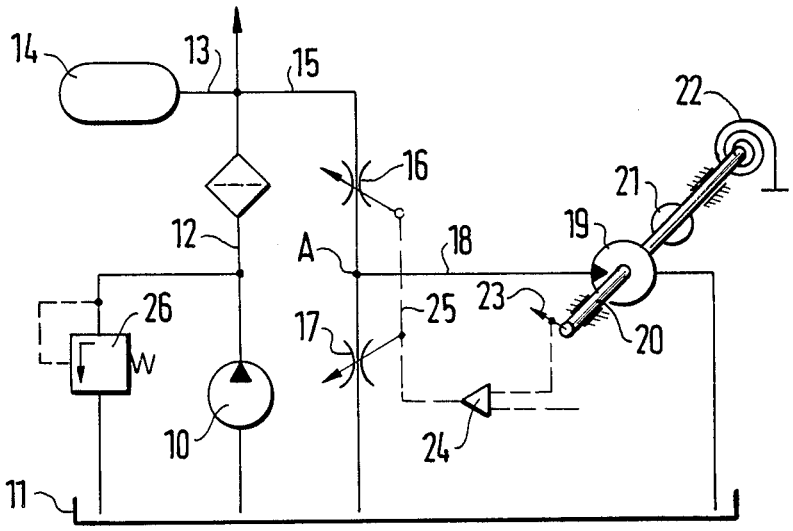
FIG. 1 is a schematic circuit diagram of the first embodiment of a throttle valve actuating device of this invention.

Referring firstly to FIG. 1, a fuel pump 10 driven by a non-illustrated internal combustion engine of a motor vehicle, delivers fuel from a fuel tank 11 into a line 12 which in this embodiment supplies fuel via a filter element to non-illustrated fuel injection valves. Downstream of the filter element, a branch line 13 leads to a pressure reservoir 14 and another branch line 15 returns excessive fuel into the fuel tank. Two adjustable throttles 16 and 17 are arranged in series in return conduit 15 to form a hydraulic bridge circuit with line 12. A line 18 leads from a connection point A between the two adjustable throttles 16 and 17 to a hydraulic setting member 19, which via a rotatably supported shaft 20 sets the angular position of a butterfly throttle valve 21 of the engine. In this embodiment, the hydraulic setting member 19 is a known rotary vane hydraulic motor which drives the shaft 20 in one direction only. The resetting spiral spring 22 is connected between a frame of the motor vehicle and shaft 20 to bias the same into a staring position. The shaft 20 is further coupled to a displacement sensor 23, for example an inductive displacement sensor which delivers a signal corresponding to an actual angular position of the shaft. The actual position signal is applied to an electronic regulating circuit 24 which compares the same with a nominal or desired signal delivered for example in response to the position of an acceleration pedal of the motor vehicle. The regulating or difference signal at the output of the regulating circuit is supplied to a suitable adjusting device 25 indicated by dashed line which adjusts the throttles 16 and 17 again in dependency on the nominal value. Depending on the adjustment of the throttles 16 and 17, the setting member 19 is supplied with more or less amount of pressure medium (fuel) and the angular position of the shaft 20 and of the throttle valve 21 are adjusted accordingly. When the opening of throttle 17 is increased, more pressure fluid flows to the tank 11 and less to the setting member 19; as a consequence, the resetting spring 22 turns the shaft 20 in opposite direction and the throttle valve 21 is turned in its closing direction. If the passage area of the throttle 17 is reduced then the flow of pressure medium to the setting member 19 is increased and throttle vale 21 is rotated in its opening direction. A pressure regulator 26 is connected parallel to the pump 10.

Figure 2:
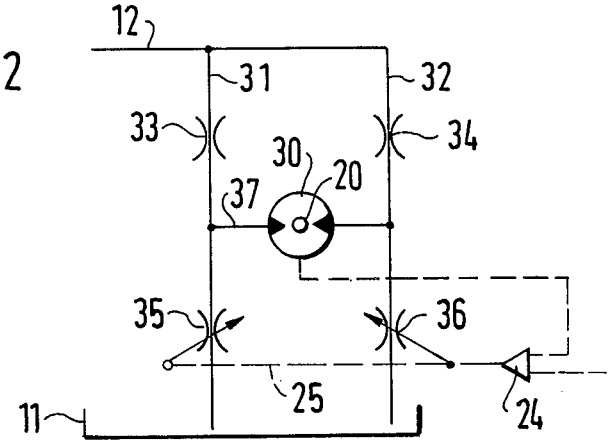
FIGS. 2 through 5 show modifications of the embodiment of FIG. 1.

In the embodiment of FIG. 2 the hydraulic setting member 30 is in the form of a double acting rotary vane type hydraulic motor having two inputs. In this embodiment two return conduits 31 and 32 branch from the fuel supply line 12 and open into the fuel tank 11. In each of the two return lines a series connection of a fixed throttle 33, 34 and an adjustable throttle 35, 36 is arranged. The inputs of the hydraulic setting member 30 are connected to the connection point between the throttles 33, 35 and 34, 36 by a conduit 37. It is evident that the throttles 33 to 36 form a hydraulic bridge circuit whereby the hydraulic setting member is connected in its diagonal. Similarly as in the preceding example, the adjustable throttles 35 and 36 are adjusted by an adjusting device 25 controlled by the regulating electronic circuit 24. A resetting spring in this embodiment is dispensed with because the respective branch conduits 31 and 32 adjust the flow through the member 30 in opposite directions. In a further modification of the embodiment of FIG. 2 it is possible to make all four throttles 33 through 36 adjustable to enhance the speed and power of the adjustment of the member 30.

Figure 3:
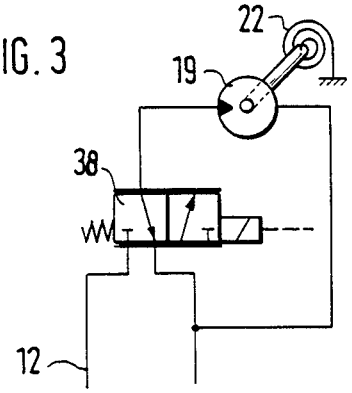

In the embodiment of FIG. 3, pressure medium supplied to the setting member 19 is controlled by a solenoid operated proportional or direction control valve 38. The solenoid is controlled by the regulating signal to reverse the direction of flow from the supply conduit 12. In this manner the amount of pressure medium supplied in either direction to the motor 19 can be metered very accurately.

Figure 4:
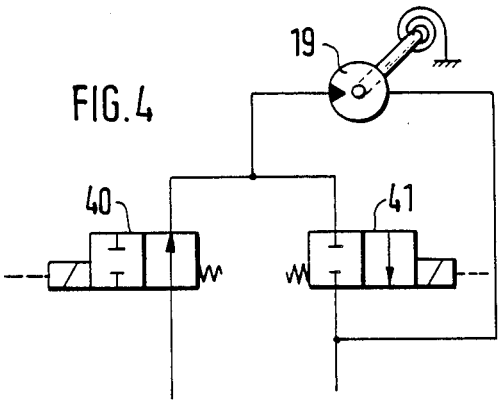

In the embodiment of FIG. 4 the direction control valve 38 is replaced by two parallel connected shut-off or switch valves 40 and 41 each being controlled by a solenoid in response to the output 35 signal from the electronic regulating circuit.

Figure 5:
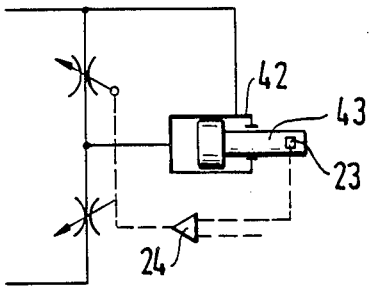

The embodiment of FIG. 5 differs from the example of FIG. 1 in that it uses an actuating cylinder 42 as a hydraulic setting member. The actuating cylinder can be either a single acting spring-loaded piston type actuating cylinder or a double-acting or differential type actuating cylinder. The piston rod 43 is again coupled with a position sensor 23 connected to the regulating circuit 24. The operation of this embodiment is the same as in the preceding examples.

While the invention has been illustrated and described as embodied in specific examples of the actuation device for a butterfly throttle valve, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for actuating a throttle valve of an internal combustion engine having a fuel pump and a throttle valve, said actuating device comprising:

hydraulic setting means coupled to the throttle valve for setting an operating position thereof in accordance with a nominal signal;

fuel flow control means connectable between the fuel pump and said hydraulic setting means for communicating to said hydraulic setting means a flow of fuel acting as a pressure medium; and means for regulating said fuel flow control means in accordance with the nominal signal and including a position sensor for sensing the operating position of the throttle valve and for generating a position signal and an electronic control circuit connectable to said position sensor and a source of the nominal signal for generating a regulating signal in accordance with the position signal and the nominal signal;

said fuel flow control means comprising two adjustable throttles and said regulating means comprising adjusting means for simultaneously adjusting said two adjustable throttles in accordance with the regulating signal to provide for fuel flow to said hydraulic setting means in accordance with the nominal signal.

2. A device according to claim 1, wherein said hydraulic setting means comprises a single-acting setting member having an initial position and a return spring for biasing said single-acting setting member to the initial position thereof.

3. A device according to claim 2, wherein said single-acting setting member comprises a rotary-vane hydraulic motor.

4. A device according to claim 2, wherein said single-acting setting member comprises a hydraulic actuating cylinder.

5. A device according to claim 1, wherein said hydraulic setting means comprises a double-acting setting member having two inputs, and said fuel flow control means comprises two pairs of seriesly connected throttles, each pair being connected to a respective input and including one of said adjustable throttles.

6. A fuel system for an internal combustion engine having fuel injection valve means and throttle valve means, said fuel supply system comprising:

a fuel reservoir;

a fuel pump communicating with said reservoir;

a conduit for communicating fuel from said fuel pump to the fuel injection valve means;

a hydraulic bridge circuit for connecting said conduit with said reservoir;

hydraulic setting means coupled to the throttle valve for setting an operating position thereof in accordance with a nominal signal;

conduit means connecting said hydraulic setting means with said hydraulic bridge circuit for communicating to said hydraulic setting means a flow of fuel acting as a pressure medium;

fuel flow control means for controlling fuel flow through said conduit means and comprising two seriesly connected throttles located in said hydraulic bridge circuit; and means for regulating said fuel flow control means in accordance with the nominal signal and including means for adjusting at least one of said throttles to provide for fuel flow through said conduit means in accordance with the nominal signal.

7. A system according to claim 6, wherein said conduit means comprises a conduit communicating with said hydraulic bridge circuit at a location between said two seriesly connected throttles, said regulating means including a position sensor for sensing the operating position of the throttle valve means and for generating a position signal, and an electronic control circuit connectable to said position sensor and a source of the nominal signal for generating a regulating signal in accordance with the position signal and the nominal signal, and for actuating said adjusting means in accordance with the regulating signal.

* * * * *